US011391509B2

(12) United States Patent
Zhu et al.

(10) Patent No.: US 11,391,509 B2
(45) Date of Patent: Jul. 19, 2022

(54) REFRIGERATOR, REFRIGERATOR DOOR AND ROTATABLE STORAGE RACK

(71) Applicant: QINGDAO HAIER CO., LTD., Qingdao (CN)

(72) Inventors: Xiaobing Zhu, Qingdao (CN); Hao Zhang, Qingdao (CN); Haoquan Liu, Qingdao (CN); Chun Yang, Qingdao (CN)

(73) Assignee: QINGDAO HAIER CO., LTD., Qingdao (CN)

( * ) Notice: Subject to any disclaimer, the term of this patent is extended or adjusted under 35 U.S.C. 154(b) by 307 days.

(21) Appl. No.: 16/643,524

(22) PCT Filed: Dec. 24, 2018

(86) PCT No.: PCT/CN2018/123086
§ 371 (c)(1),
(2) Date: Feb. 28, 2020

(87) PCT Pub. No.: WO2019/141049
PCT Pub. Date: Jul. 25, 2019

(65) Prior Publication Data

US 2020/0348075 A1 Nov. 5, 2020

(30) Foreign Application Priority Data

Jan. 19, 2018 (CN) ..... 201810055375.6

(51) Int. Cl.
*F25D 25/02* (2006.01)
*F25D 23/04* (2006.01)

(52) U.S. Cl.
CPC ..... *F25D 25/027* (2013.01); *F25D 25/025* (2013.01); *F25D 23/04* (2013.01); *F25D 2500/02* (2013.01)

(58) Field of Classification Search
CPC ..... F25D 25/027; F25D 25/025; F25D 23/04; F25D 2500/02
See application file for complete search history.

(56) References Cited

U.S. PATENT DOCUMENTS 9,285,160 B1 * 3/2016 Kang ..... F25D 25/025
2015/0176887 A1 6/2015 Castro Solis et al.
(Continued)

FOREIGN PATENT DOCUMENTS

CN 102228343 A 11/2011
CN 102937359 A 2/2013
(Continued)

OTHER PUBLICATIONS

English Translation of EP-0779484-A2 (Year: 1997).*

*Primary Examiner* — David J Teitelbaum
(74) *Attorney, Agent, or Firm* — Cheng-Ju Chiang

(57) ABSTRACT

The present invitation provides a rotatable storage rack, including a drawer, a storage rack body for slidingly receiving the drawer, and a sliding assembly disposed between the drawer and the storage rack body; wherein the sliding assembly includes a curved slide rail and a first pulley moving along the curved slide rail, the curved slide rail includes a horizontal section and a bent section, and the bent section is tangent to the horizontal section and arranged at an angle; when the first pulley moves along the horizontal section, the drawer is pulled out when the first pulley moves along the bent section, the drawer rotates downward.

9 Claims, 4 Drawing Sheets

(56) References Cited

U.S. PATENT DOCUMENTS

| | | | | |
|---|---|---|---|---|
| 2017/0241699 | A1* | 8/2017 | Osbar | E05C 19/168 |
| 2019/0041123 | A1* | 2/2019 | Lee | A47B 88/60 |

FOREIGN PATENT DOCUMENTS

| | | | | |
|---|---|---|---|---|
| CN | 102944100 | A | 2/2013 | |
| CN | 203216197 | U | 9/2013 | |
| CN | 104540418 | A | 4/2015 | |
| CN | 106240426 | A | 12/2016 | |
| CN | 108195131 | A | 6/2018 | |
| EP | 0779484 | A2 * | 6/1997 | F25D 23/025 |
| JP | 2001-280829 | A | 10/2001 | |
| JP | 2003-279243 | A | 10/2003 | |
| JP | 2007-46807 | A | 2/2007 | |

* cited by examiner

REFRIGERATOR, REFRIGERATOR DOOR AND ROTATABLE STORAGE RACK

The present application is a 35 U.S.C. § 371 National Phase conversion of International (PCT) Patent Application No. PCT/CN2018/123086, filed on Dec. 24, 2018, which claims priority to Chinese Patent Application No. 201810055375.6, filed on Jan. 19, 2018 and tiled "REFRIGERATOR, REFRIGERATOR DOOR AND ROTATABLE STORAGE RACK", which is incorporated herein by reference in its entirety. The PCT International Patent Application was filed and published in Chinese.

TECHNICAL FIELD

The present invention relates to a refrigerator, a refrigerator door and a rotatable storage rack, and belongs to the field of refrigeration equipment.

BACKGROUND

In recent years, more and more refrigerators provide independent dry-zone space to facilitate a user to store foods such as multigrain and dried food. It is a sensible act to provide the dry zones on a refrigeration door of the refrigerator because the dry zones are easily accessible and improve the user's convenience in accessing the articles. Furthermore, multi-layer dry zones on the door facilitate classification, so the user may finely partition the zones according to his own needs and avoid transfer of odor of different food.

However, a conventional storage rack disposed on the door of the refrigerator has an undesirable sealing performance. Even though the storage rack has a cover that can provide full covering, a serious problem such as air leakage is caused due to a large assembling gap, so that humidity in the interior of the storage rack is made uncontrollable and dried food cannot be stored in the storage rack as a dry zone. In addition, if the dry zones on the door are disposed in a middle-upper portion of the refrigeration door or refrigeration compartment, users with ordinary height cannot access articles conveniently.

In view of this, it is necessary to provide a novel dry-zone structure which provides high sealing performance and facilitates the user to access articles, to solve the above problems.

SUMMARY

An object of the present invention is to provide a novel dry zone structure, which can improve the sealing performance, ensure dryness of food materials, improve the user's convenience in accessing articles, and avoid reduction of consumption satisfaction due to insufficient height of the user.

To implement the above object, the present invention employs the following technical solution: a rotatable storage rack, comprising a drawer, a storage rack body for slidingly receiving the drawer, and a sliding assembly disposed between the drawer and the storage rack body; wherein the sliding assembly comprises a curved slide rail and a first pulley moving along the curved slide rail, the curved slide rail comprises a horizontal section and a bent section, and the bent section is tangent to the horizontal section and arranged at an angle; when the first pulley moves along the horizontal section, the drawer is pulled out; when the first pulley moves along the bent section, the drawer rotates downward.

As a further improved technical solution of the present invention, the curved slide rail is disposed near a top of the drawer, the sliding assembly further comprises a second slide rail disposed away from the top of the drawer and a second pulley moving along the second slide rail, the second slide rail extends from a start point to an end point in a horizontal direction, and the bent section is configured as a circular arc with the end point of the second slide rail as a center of a circle and with a vertical distance from the horizontal section to the second slide rail as a radius.

As a further improved technical solution of the present invention, the rotatable storage rack comprises a latch structure comprising a male portion and a female portion, the male portion is provided on one of the drawer and the storage rack body, the female portion is disposed on the other of the drawer and the storage rack body, and the male portion and the female portion cooperate with each other unlockably.

As a further improved technical solution of the present invention, the sliding assembly comprises a support plate connected to the storage rack body, the curved slide rail is provided on one of the drawer and the support plate, and the first pulley is disposed on the other of the drawer and the support plate.

As a further improved technical solution of the present invention, the sliding assembly further comprises a sub-sliding mechanism, and the support plate is slidably connected to the storage rack body through the sub-sliding mechanism to increase a distance that the drawer may be drawn out.

As a further improved technical solution of the present invention, the sub-sliding mechanism comprises a third pulley provided on one of the support plate and the storage rack body, and a third slide rail disposed on the other of the support plate and the storage rack body, and the third pulley is received in the third slide rail and movable along the third slide rail.

As a further improved technical solution of the present invention, the sub-sliding mechanism further comprises a limiting member, the limiting member is provided on the support plate, the storage rack body is provided with a stop surface cooperating with the limiting member, and the limiting member cooperates with the stop surface to limit further displacement of the support plate relative to the storage rack body.

As a further improved technical solution of the present invention, the limiting member is an elastic piece extending in a horizontal direction, the horizontal direction is opposite to a direction in which the support plate is drawn out relative to the storage rack body, a free end of the elastic piece is provided with an inverted snap, the inverted snap has a limiting surface perpendicular to the horizontal direction, and the limiting surface abuts against the stop surface when the support plate moves to a limiting position relative to the storage rack body.

To achieve the above object of the present invention, the present invention further provides a refrigerator door comprising the above-mentioned rotatable storage rack.

To achieve the above object of the present invention, the present invention further provides a refrigerator comprising the above-mentioned rotatable storage rack.

Advantageous effects of the present invention are as follows: as compared with the prior art, the rotatable storage rack according to the present invention has the thus arranged curved slide rail so that the drawer can rotate downward by a certain angle after being horizontally pulled to an extreme position, so that users not tall enough can conveniently access food, thereby enhancing the user's consumption experience. Furthermore, the gapless fitting of the drawer and the storage rack body facilitates the storage rack to be independently controlled as a dry zone in terms of dryness and humidity, and avoids the problems such as air leakage and undesirable sealing performance.

DETAILED DESCRIPTION

Figure 1:
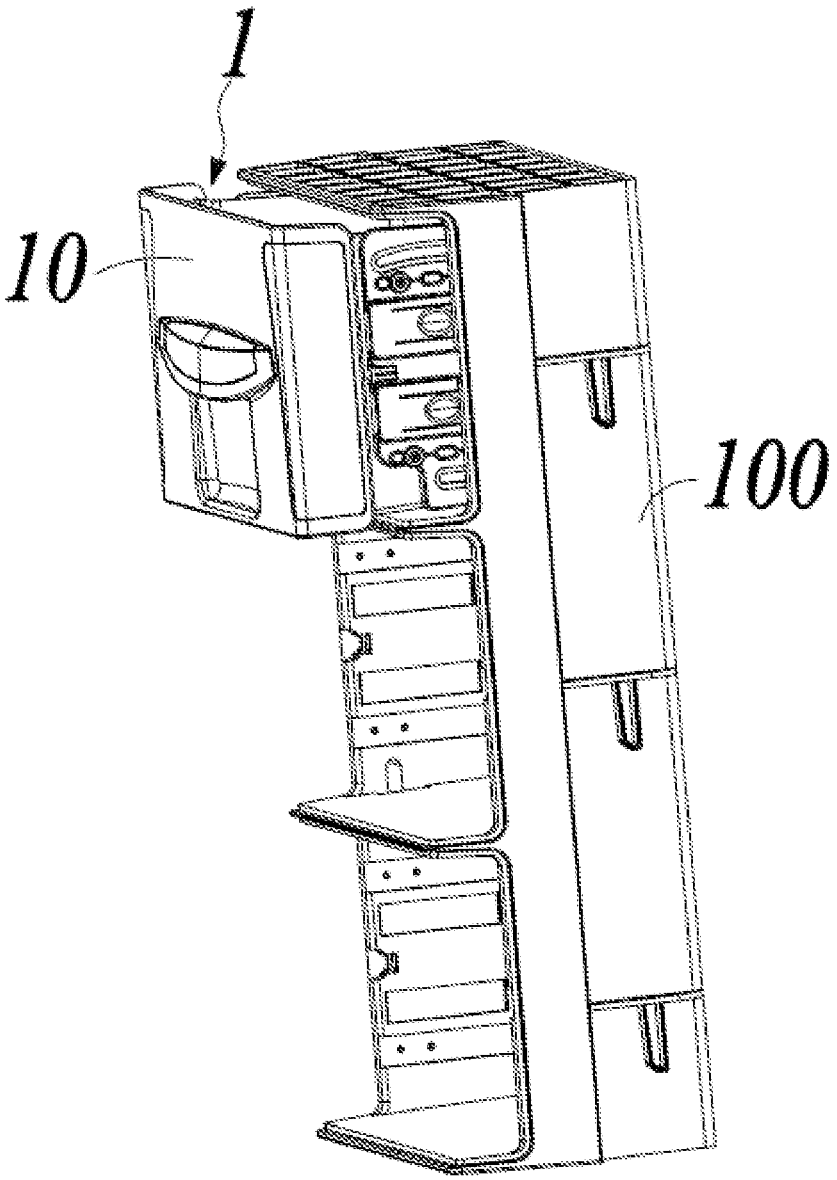
FIG. 1 is a perspective view of a refrigerator door in a preferred embodiment of the present invention.

The present invention will be described below in detail in combination with specific embodiments illustrated in drawings. However, these embodiments have no limitations on the present invention, and any transformations of structure, method, or function made by persons skilled in the art according to these embodiments fall within the protection scope of the present invention.

The terms expressive of spatial relative positions, such as "upper", "above", "lower", "below", or the like herein are used to describe the relationship of a unit or feature relative to another unit or feature in the drawings, for the purpose of illustration and description. Terms expressive of the spatial relative positions are intended to comprise different orientations of the device in use or operation other than the orientations shown in the drawings. For example, if the device in the drawings is turned over, the units which are described to be located "below" or "under" other units or features are "above" other units or features. Therefore, the exemplary term "below" may comprise both the "above" and "below" orientations. The device may be oriented (rotated by 90 degrees or other orientations) in other ways, correspondingly explaining the expressions related to the space herein. Also, it should be understood that although the terms of first, second, etc. may be used herein to describe various elements or structures, these described objects should not be limited by them. These terms are merely used to distinguish these described objects.

A preferred refrigerator of the present invention comprises a refrigerator door. The refrigerator door comprises a housing, an inner liner 100, and a foaming material filled between the housing and the inner liner 100. As shown in FIG. 1, in the present preferred embodiment, the inner liner 100 of the door is integrally formed, it comprises three layers of compartments, and each compartment may be used alone as an ordinary storage rack 1 to open to place bottle can-like articles such as beverage bottles and wine bottles, and may also be provided as an independent dry zone. Certainly, the designer may appropriately adjust the number of compartments in the inner liner 100 according to different refrigerator specifications and use needs.

For ease of description, FIG. 1 shows only one storage rack 1 used as a dry zone, which is located on the top of the compartment. The storage rack 1 comprises a drawer 10, a storage rack body 20 for slidingly receiving the drawer 10, and a sliding assembly disposed between the drawer 10 and the storage rack body 20. The storage rack body 20 is disposed in the inner liner 100 of the door. In the present embodiment, the storage rack body 20 is an inner liner 100 formed by a bottom wall, a top wall, left and right side walls, and a rear wall. The storage rack body 20 slideably receives the drawer 10. When the drawer 10 completely enters the storage rack body 20, the interior of the storage rack 1 is well sealed, and may serve as a dry zone of which temperature and humidity can be regulated and controlled independently, thereby ensuring dryness of food materials and avoiding undesirable sealing performance of a conventional storage rack 1 caused by an assembling gap of a cover body.

Figure 3:
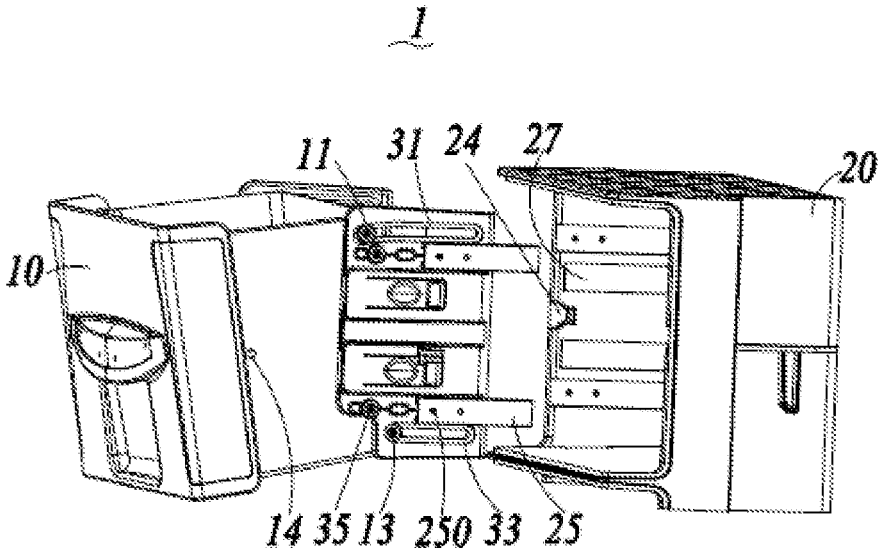
FIG. 3 is an exploded view of the rotatable storage rack shown in FIG. 2.

As shown in FIG. 3, the storage rack 1 comprises a latch structure comprising a male portion and a female portion, the male portion is provided on one of the drawer 10 and the storage rack body 20, the female portion is disposed on the other of the drawer 10 and the storage rack body 20, and the male portion and the female portion cooperate with each other unlockably. As shown in FIG. 3, the male portion is configured as a snap 14 connected to one end of the drawer 10, the female portion is provided on the storage rack body 20 and configured as a catch groove 24 which receives the snap 24 and able to release the snap 24, a spring is disposed in the catch groove 24 to facilitate elastically releasing the snap 14 when needs to unlock the snap 14.

Figure 2:
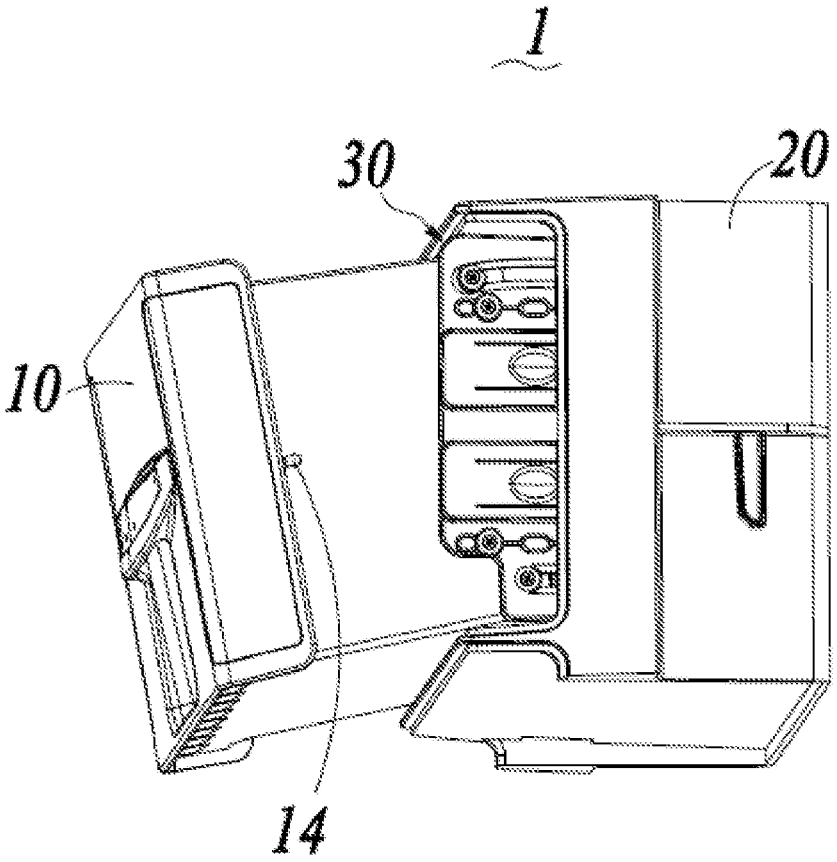
FIG. 2 is a perspective view of a rotatable storage rack in the refrigerator door shown in FIG. 1.

As shown in FIG. 2, a sliding assembly is provided between the storage rack body 20 and the drawer 10. In the present embodiment, the sliding assembly is symmetrically disposed between two side walls of the drawer 10 and left and right side walls of the storage rack body 20. For the convenience of description, only the sliding assembly on the right side of the figure (at a bottom right side of the figure) is taken as an example for description.

As shown in FIG. 2 and FIG. 3, the sliding assembly comprises a curved slide rail 31 and a first pulley 11 moving along the curved slide rail 31. the curved slide rail 31 comprises a horizontal section 310 and a bent section 312, and the bent section 312 is tangent to the horizontal section 310 and arranged at an angle. When the first pulley 11 moves along the horizontal section 310, the drawer 10 is pulled out. When the first pulley 11 moves along the bent section 312, the drawer 10 rotates downward. The storage rack 1 provided in the present embodiment has the above-mentioned curved slide rail 31, so that the drawer 10 can rotate downward by a certain angle after being pulled to an extreme position, so that users not tall enough can conveniently access food.

Further referring to FIG. 3, the curved slide rail 31 is disposed near a top of the drawer 10, the sliding assembly further comprises a second slide rail 33 disposed away from the top of the drawer 10 and a second pulley 13 moving along the second slide rail 33, the second slide rail 33 extends from a start point to an end point in a horizontal direction, and the bent section 312 is configured as a circular arc with the end point of the second slide rail 33 as a center of a circle and with a vertical distance from the horizontal section 310 to the second slide rail 33 as a radius. The provision of the second slide rail 33 makes the connection of the drawer 10 and the storage rack body 20 firmer and avoids the damage of a single slide rail as bearing a larger weight;

meanwhile, the second slide rail 33 and the curved slide rail 31 are disposed at the top and bottom of the side wall of the drawer 10, respectively so that the user can save labor upon turning the drawer 10 with the end point of the second slide rail 33 as a pivot.

Further referring to FIG. 2 and FIG. 3, the second slide rail 33 and the horizontal section 310 of the curved slide rail 31 are parallel and equal in length. In other words, when the user pulls the drawer 10, the first pulley 11 moves relative to the curved slide rail 31 in the horizontal direction, and at the same time, the second pulley 13 moves relative to the second slide rail 33 in the horizontal direction until the second pulley 13 reaches the end point position of the second slide rail 33. When the second pulley 13 moves to the end point position of the second slide rail 33, the second pulley 13 is limited. At this time, the user rotates the drawer 10 downward, and the first pulley 11 continues to move along the bent section 312, so that the drawer 10 rotates downward by an angle of a central angle corresponding to the circular arc-shaped bent section 312.

In the present embodiment, the sliding assembly comprises a support plate 30 connected to the storage rack body 20, the curved slide rail 31 is provided on one of the drawer 10 and the support plate 30, and the first pulley 11 is disposed on the other of the drawer 10 and the support plate 30. In the present embodiment, the curved slide rail 31 is provided on the support plate 30, and the first pulley 11 is connected to the top of the side wall of the drawer 10 by screws. In addition, the second slide rail 33 is also disposed on the support plate 30. Correspondingly, the second pulley 13 is connected to the bottom of the side wall of the drawer 10 by screws. Certainly, in a variant embodiment, the relative movement of the pulley and the slide rail may also be achieved by reversing the positions of the first pulley 11 and the curved slide rail 31, and by reversing the positions of the second pulley 13 and the second slide rail 33 simultaneously or non-simultaneously.

The sliding assembly further comprises a sub-sliding mechanism, and the support plate 30 is slidably connected to the storage rack body 20 through the sub-sliding mechanism to increase a distance that the drawer 10 may be drawn out. Furthermore, the sub-sliding mechanism comprises a third pulley 35 provided on one of the support plate 30 and the storage rack body 20, and a third slide rail 25 disposed on the other of the support plate 30 and the storage rack body 20, and the third pulley 35 is received in the third slide rail 25 and movable along the third slide rail 25. The sub-sliding mechanism enables relative movement between the support plate 30 and the storage rack body 20, thereby increasing the distance that the drawer 10 may be pulled out relative to the storage rack body 20.

Figure 4:
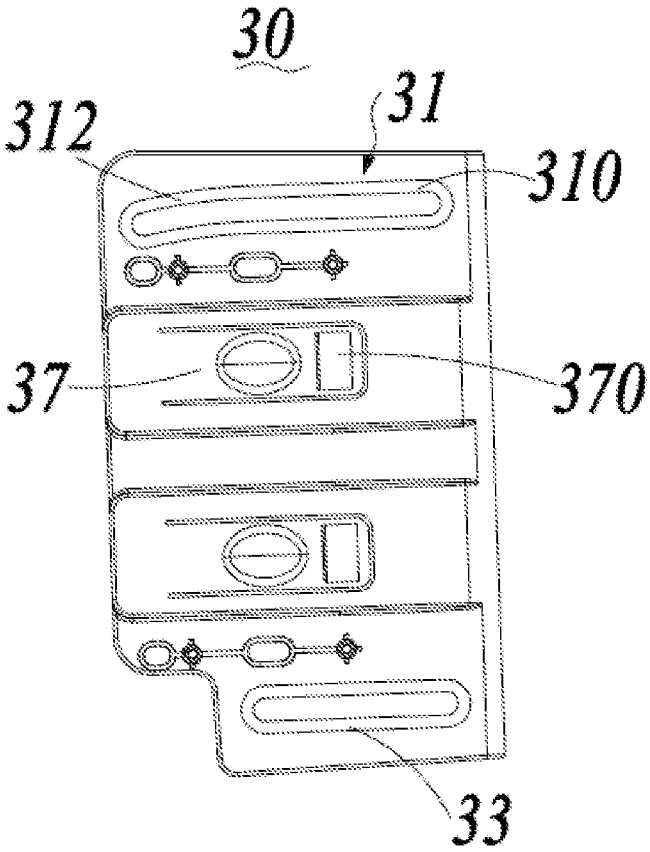
FIG. 4 is a schematic structural diagram of a support plate of the rotatable storage rack shown in FIG. 2.

As shown in FIG. 4, the third pulley 35 is connected to the support plate 30, the third slide rail 25 is provided with a mounting hole 250, and a fastener passes through the mounting hole 250 to fix the third slide rail 25 on the storage rack body 20. The sub-sliding mechanism of the present embodiment comprises two pairs of third pulleys 35 and third slide rails 25. Certainly, in other embodiments, only one pair of such sub-sliding mechanisms may be provided.

As shown in FIG. 4, the sub-sliding mechanism further comprises a limiting member 37, the limiting member 37 is provided on the support plate 30, the storage rack body 20 is provided with a stop surface cooperating with the limiting member 37, and the limiting member 37 cooperates with the stop surface to limit further displacement of the support plate 30 relative to the storage rack body 20, to prevent the support plate 30 from being totally pulled out and further preventing the drawer 10 from falling off.

With reference to FIG. 3 and FIG. 4, the present embodiment provides two limiting members 37 which are elastic pieces extending in a horizontal direction, an extending direction of the elastic pieces is opposite to a direction in which the support plate 30 is drawn out relative to the storage rack body 20, a free end of the elastic piece is provided with an inverted snap 370, the inverted snap 370 has a limiting surface perpendicular to the horizontal direction, and, the limiting surface abuts against the stop surface when the support plate 30 moves to a limiting position relative to the storage rack body 20. Such an arrangement enables the limiting member 37 to allow a proper amount of elastic deformation when the support plate 30 enters the storage rack body 20 inward, thereby preventing inner wall of the storage rack body 20 from being scratched and damaged by the inverted snap 370. Furthermore, the inner wall of the storage rack body 20 is provided with a stop groove 27 provided along the moving direction of the limiting member 37, the stop groove 27 receives the inverted snap 370 and allows the inverted snap 370 to move therein, and the stop surface is formed as an end face of the stop groove 27.

Figure 5:
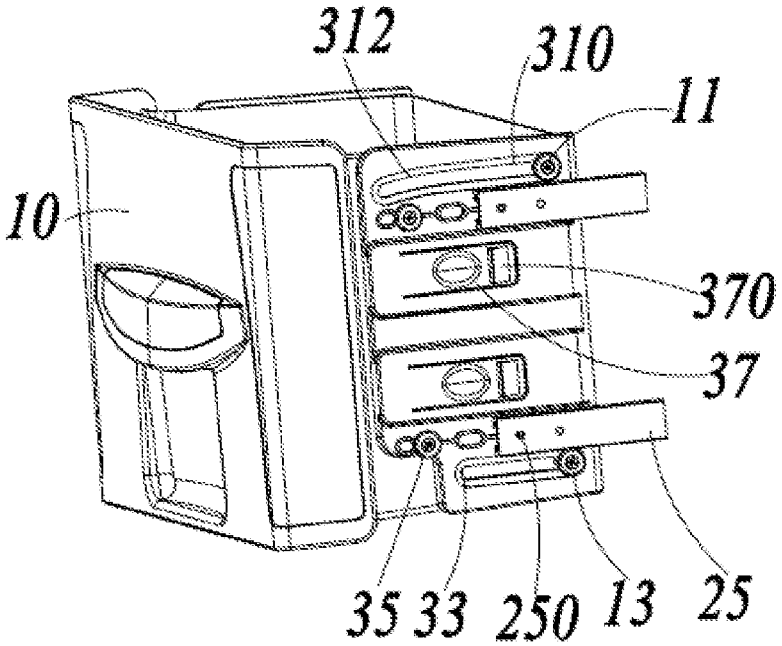
FIG. 5 is a schematic view in which a drawer of the rotatable storage rack shown in FIG. 2 is in an initial movement state.

As shown in FIG. 5, when the user needs to pull out the drawer 10, the support plate 30 first moves relative to the storage rack body 20, i.e., the support plate 30 drives the third pulley 35 to slide relative to the third slide rail 25 until the limiting surface of the limiting member 37 abuts against the stop surface of the storage rack body 20, and the support plate 30 is limited. The drawer 10 is further pulled, the drawer 10 starts to move relative to the support plate 30, the first pulley 11 moves from a start point to an end point along the horizontal section 310 of the curved slide rail 31, and the second pulley 13 moves from the start point to the end point of the second slide rail 33.

Figure 6:
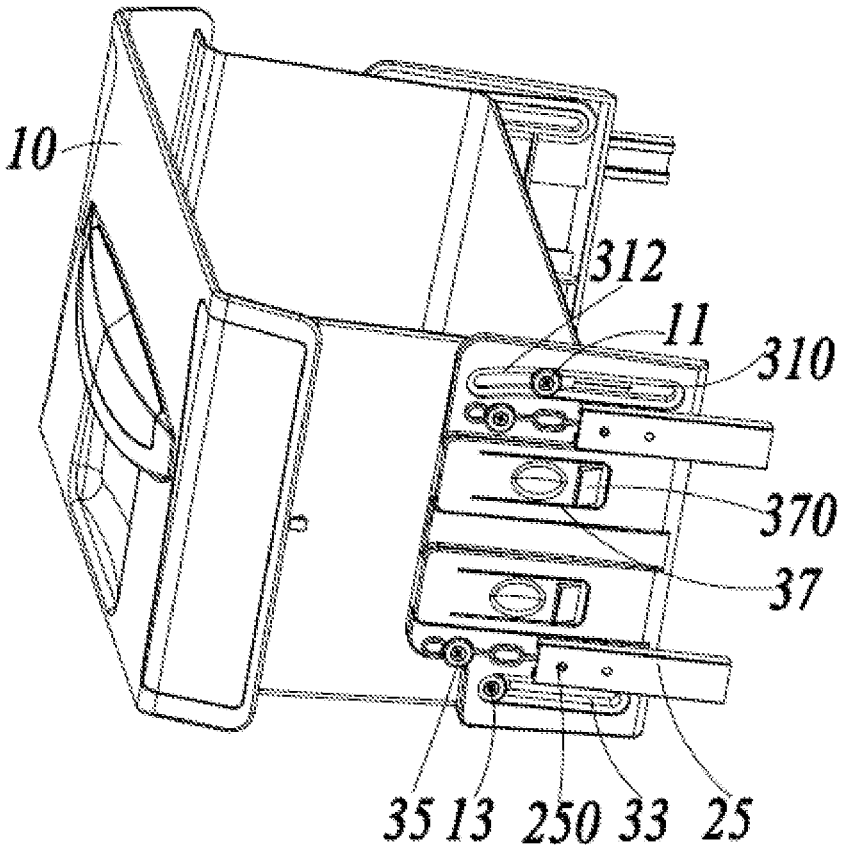
FIG. 6 is a schematic view in which the drawer of the rotatable storage rack shown in FIG. 2 is in an intermediate movement state.

As shown in FIG. 6, the first pulley 11 moves to the end point of the horizontal section 310 and the second pulley 13 moves to the end point of the second slide rail 33, whereupon the second pulley 13 is limited. If the drawer 10 is further pulled, the first pulley 11 enters the bent section 312 and slides along the bent section 312 until it reaches the end point of the bent section 312 (as shown in FIG. 2). At this time, the drawer 10 rotates downward by a certain angle, thereby improving the convenience for the user in picking and placing articles.

In summary, the storage rack 1 provided in the present embodiment avoids the problem of air leakage due to the assembling gap because the temperature and humidity of the storage rack 1 is adapted to be controlled independently due to the excellent sealing performance formed between the drawer 10 and the storage rack body 20; in addition, the curved slide rail 31 having the bent section 312 is provided between the drawer 10 and the storage rack body 20, so that the drawer 10 can rotate down relative to the storage rack body 20, thereby reducing the height of the drawer 10 and meeting the need of users not tall enough to access articles. In the above embodiment, the storage rack 1 is provided on the door of the refrigerator. Certainly, in a variant embodiment, the storage rack 1 may also be provided in the cabinet of the refrigerator.

It should be understood that although the present specification is described based on embodiments, not every embodiment contains only one independent technical solution. Such a narration way of the present specification is only for the sake of clarity. Those skilled in the art should take the present specification as an entirety. The technical solutions in the respective embodiments may be combined properly to form other embodiments which may be understood by those skilled in the art.

A series of the detailed descriptions set forth above is merely specific description of feasible embodiments of the present invention, and is not intended to limit the protection scope of the present invention. Equivalent embodiments or modifications made within the spirit of the present invention shall fall within the protection scope of the present invention.

What is claimed is:

1. A rotatable storage rack, comprising a drawer, a storage rack body for slidingly receiving the drawer, and a sliding assembly disposed between the drawer and the storage rack body; wherein the sliding assembly comprises a curved slide rail and a first pulley moving along the curved slide rail, the curved slide rail comprises a horizontal section and a bent section, and the bent section is tangent to the horizontal section and arranged at an angle; when the first pulley moves along the horizontal section, the drawer is pulled out; when the first pulley moves along the bent section, the drawer rotates downward;

the sliding assembly comprises a support plate connected to the storage rack body, the curved slide rail is provided on one of the drawer and the support plate, and the first pulley is disposed on the other of the drawer and the support plate.

2. The rotatable storage rack according to claim 1, wherein the curved slide rail is disposed near a top of the drawer, the sliding assembly further comprises a second slide rail disposed away from the top of the drawer and a second pulley moving along the second slide rail, the second slide rail extends from a start point to an end point in a horizontal direction, and the bent section is configured as a circular arc with the end point of the second slide rail as a center of a circle and with a vertical distance from the horizontal section to the second slide rail as a radius.

3. The rotatable storage rack according to claim 1, wherein comprising a latch structure comprising a male portion and a female portion, the male portion is provided on one of the drawer and the storage rack body, the female portion is disposed on the other of the drawer and the storage rack body, and the male portion and the female portion cooperate with each other unlockably.

4. The rotatable storage rack according to claim 1, wherein the sliding assembly further comprises a sub-sliding mechanism, and the support plate is slidably connected to the storage rack body through the sub-sliding mechanism to increase a distance that the drawer may be drawn out.

5. The rotatable storage rack according to claim 4, wherein the sub-sliding mechanism comprises a third pulley provided on one of the support plate and the storage rack body, and a third slide rail disposed on the other of the support plate and the storage rack body, and the third pulley is received in the third slide rail and movable along the third slide rail.

6. The rotatable storage rack according to claim 4, wherein the sub-sliding mechanism further comprises a limiting member, the limiting member is provided on the support plate, the storage rack body is provided with a stop surface cooperating with the limiting member, and the limiting member cooperates with the stop surface to limit further displacement of the support plate relative to the storage rack body.

7. The rotatable storage rack according to claim 6, wherein the limiting member is an elastic piece extending in a horizontal direction, the horizontal direction is opposite to a direction in which the support plate is drawn out relative to the storage rack body, a free end of the elastic piece is provided with an inverted snap, the inverted snap has a limiting surface perpendicular to the horizontal direction, and the limiting surface abuts against the stop surface when the support plate moves to a limiting position relative to the storage rack body.

8. A refrigerator door, wherein comprising the rotatable storage rack according to claim 1.

9. A refrigerator, wherein comprising the rotatable storage rack according to claim 1.

* * * * *